US009103020B2

(12) United States Patent
Gong et al.

(10) Patent No.: US 9,103,020 B2
(45) Date of Patent: Aug. 11, 2015

(54) METALIZED PLASTIC ARTICLES AND METHODS THEREOF

(75) Inventors: Qing Gong, Shenzhen (CN); Liang Zhou, Shenzhen (CN); Weifeng Miao, Shenzhen (CN); Xiong Zhang, Shenzhen (CN)

(73) Assignee: BYD Company Limited, Shenzhen, Guangdong (CN)

( * ) Notice: Subject to any disclaimer, the term of this patent is extended or adjusted under 35 U.S.C. 154(b) by 238 days.

(21) Appl. No.: 12/950,904

(22) Filed: Nov. 19, 2010

(65) Prior Publication Data

US 2011/0212344 A1 Sep. 1, 2011

(30) Foreign Application Priority Data

Feb. 26, 2010 (CN) ..... 2010 1 0117125

(51) Int. Cl.

| | |
|---|---|
| ***B05D 3/00*** | (2006.01) |
| ***C08J 7/18*** | (2006.01) |
| ***G21H 5/00*** | (2006.01) |
| ***C23C 18/20*** | (2006.01) |
| ***C23C 18/16*** | (2006.01) |
| ***C25D 5/56*** | (2006.01) |

(52) U.S. Cl.

CPC ..... *C23C 18/204* (2013.01); *C23C 18/1641* (2013.01); *C23C 18/1651* (2013.01); *C23C 18/1653* (2013.01); *C25D 5/56* (2013.01); *Y10T 428/12569* (2015.01)

(58) Field of Classification Search

CPC ..... C23C 18/14; C23C 18/04; C23C 18/20; C23C 18/1641; C23C 18/1651; C23C 18/204

USPC ..... 427/443.1, 532, 551, 552, 553, 554, 427/555

See application file for complete search history.

(56) References Cited

U.S. PATENT DOCUMENTS

| | | | | |
|---|---|---|---|---|
| 3,056,881 | A | 10/1962 | Schwarz | |
| 3,226,256 | A | 12/1965 | Schneble, Jr. et al. | |
| 3,234,044 | A | 2/1966 | Andes et al. | |
| 3,305,460 | A | 2/1967 | Lacy | |
| 3,546,011 | A | 12/1970 | Knorre et al. | |
| 3,627,576 | A | 12/1971 | Knorre et al. | |
| 3,799,802 | A | 3/1974 | Schneble, Jr. et al. | |
| 3,804,740 | A | 4/1974 | Welch | |
| 4,087,586 | A | 5/1978 | Feldstein | |
| 4,159,414 | A | 6/1979 | Suh et al. | |
| 4,416,932 | A | 11/1983 | Nair | |
| 4,426,442 | A | 1/1984 | Molenaar et al. | |
| 4,550,140 | A | 10/1985 | Rimsa et al. | |
| 4,555,414 | A * | 11/1985 | Hoover et al. | 427/504 |
| 4,585,490 | A | 4/1986 | Raffel et al. | |
| 4,767,665 | A | 8/1988 | Seeger | |
| 4,772,496 | A * | 9/1988 | Maeda et al. | 428/35.9 |
| 4,810,663 | A | 3/1989 | Raffel et al. | |
| 4,841,099 | A | 6/1989 | Epstein et al. | |
| 4,853,252 | A | 8/1989 | Frankel et al. | |
| 4,894,115 | A * | 1/1990 | Eichelberger et al. | 134/1.1 |
| 5,082,739 | A | 1/1992 | Roy et al. | |
| 5,096,882 | A | 3/1992 | Kato et al. | |
| 5,162,144 | A | 11/1992 | Brown et al. | |
| 5,198,096 | A | 3/1993 | Foust et al. | |
| 5,281,447 | A | 1/1994 | Brady et al. | |
| 5,378,508 | A | 1/1995 | Castro et al. | |
| 5,422,383 | A | 6/1995 | Takahashi et al. | |
| 5,576,073 | A | 11/1996 | Kickelhain | |
| 5,585,602 | A | 12/1996 | Bernstein | |
| 5,599,592 | A | 2/1997 | Laude | |

(Continued)

FOREIGN PATENT DOCUMENTS

| | | |
|---|---|---|
| CN | 1370806 A | 9/2002 |
| CN | 1444632 A | 9/2003 |

(Continued)

OTHER PUBLICATIONS

Marquardt et al., "Crystal chemistry and electrical properties of the delafossite structure", *Thin Solid Films*, vol. 496, 2006 (4 pages).

Non-final Office Action dated Nov. 26, 2012, issued in related U.S. Appl. No. 13/103,859 (13 pages).

Final Office Action dated Jul. 12, 2013, issued in related U.S. Appl. No. 13/103,859 (15 pages).

Non-final Office Action dated Nov. 29, 2012, issued in related U.S. Appl. No. 13/186,280 (19 pages).

Final Office Action dated Jul. 11, 2013, issued in related U.S. Appl. No. 13/186,280 (21 pages).

Non-final Office Action dated May 25, 2012, issued in related U.S. Appl. No. 13/354,512 (12 pages).

Final Office Action dated Jan. 7, 2013, issued in related U.S. Appl. No. 13/354,512 (13 pages).

Non-final Office Action dated Jun. 25, 2013, issued in related U.S. Appl. No. 13/354,512 (12 pages).

(Continued)

*Primary Examiner* — Michael Wieczorek

(74) *Attorney, Agent, or Firm* — Finnegan, Henderson, Farabow, Garrett & Dunner, LLP

(57) ABSTRACT

Metalized plastic substrates, and methods thereof are provided herein. The method includes providing a plastic having a plurality of accelerators dispersed in the plastic. The accelerators have a formula $AM_xB_yO_z$, in which A is one or more elements selected from groups 10 and 11 of the Element Periodic Table; M is one or more metal elements in three plus selected from the group consisting of Fe, Co, Mn, Al, Ga, In, Tl, and rare earth elements; and O is oxygen; and x=0-2, y=0.01-2; z=1-4; and the accelerators further have a formula $A'M'_mO_n$, in which A' is one or more elements selected from groups 9, 10, and 11 of the periodic table; M is one or more elements selected from the group consisting of Cr, Mo, W, Se, Te, and Po; and O is oxygen; and m=0.01-2; n=2-4. The method includes the step of irradiating a surface of plastic substrate to expose at least a first accelerator. The method further includes plating the irradiated surface of the plastic substrate to form at least a first metal layer on the at least first accelerator, and then plating the first metal layer to form at least a second metal layer.

13 Claims, No Drawings

(56) References Cited

U.S. PATENT DOCUMENTS

| | | | | |
|---|---|---|---|---|
| 5,702,584 | A | 12/1997 | Goenka et al. | |
| 5,838,063 | A | 11/1998 | Sylvester | |
| 5,856,395 | A | 1/1999 | Tanisho et al. | |
| 5,955,179 | A | 9/1999 | Kickelhain et al. | |
| 6,194,032 | B1 | 2/2001 | Svedberg et al. | |
| 6,198,197 | B1 | 3/2001 | Yamanouchi et al. | |
| 6,277,319 | B2 | 8/2001 | Hardgrove et al. | |
| 6,417,486 | B1 | 7/2002 | Reil et al. | |
| 6,696,173 | B1 | 2/2004 | Naundorf et al. | |
| 6,706,785 | B1 | 3/2004 | Fu | |
| 6,743,345 | B2 | 6/2004 | Belouet et al. | |
| 6,818,678 | B2 | 11/2004 | Yamaguchi et al. | |
| 6,951,816 | B2 | 10/2005 | Nopper et al. | |
| 7,060,421 | B2 | 6/2006 | Naundorf et al. | |
| 7,576,140 | B2 | 8/2009 | Tamaki et al. | |
| 2002/0046996 | A1 | 4/2002 | Reil et al. | |
| 2002/0076911 | A1 | 6/2002 | Lin | |
| 2003/0031803 | A1 | 2/2003 | Belouet et al. | |
| 2003/0042144 | A1 | 3/2003 | Isono et al. | |
| 2003/0134558 | A1 | 7/2003 | Lien et al. | |
| 2004/0026254 | A1 | 2/2004 | Hupe et al. | |
| 2004/0101665 | A1* | 5/2004 | Seita et al. | 428/209 |
| 2004/0241422 | A1 | 12/2004 | Naundorf et al. | |
| 2005/0023248 | A1* | 2/2005 | Ichimura et al. | 216/87 |
| 2005/0064711 | A1 | 3/2005 | Kliesch et al. | |
| 2005/0069688 | A1 | 3/2005 | Kliesch et al. | |
| 2005/0269740 | A1 | 12/2005 | Guns et al. | |
| 2006/0145782 | A1 | 7/2006 | Liu et al. | |
| 2006/0286365 | A1 | 12/2006 | Lee et al. | |
| 2007/0014975 | A1* | 1/2007 | Ota | 428/209 |
| 2007/0075050 | A1* | 4/2007 | Heyl | 219/121.6 |
| 2007/0154561 | A1* | 7/2007 | Takeda et al. | 424/489 |
| 2007/0247822 | A1 | 10/2007 | Naundorf | |
| 2008/0015320 | A1 | 1/2008 | Lee et al. | |
| 2008/0092806 | A1 | 4/2008 | West et al. | |
| 2009/0292048 | A1 | 11/2009 | Li et al. | |
| 2009/0292051 | A1 | 11/2009 | Li et al. | |
| 2010/0021657 | A1 | 1/2010 | Lochtman et al. | |
| 2010/0080958 | A1 | 4/2010 | Goelling | |
| 2010/0266752 | A1 | 10/2010 | Tseng et al. | |
| 2011/0048783 | A1 | 3/2011 | Yu | |
| 2011/0177359 | A1 | 7/2011 | Gong et al. | |
| 2011/0212345 | A1 | 9/2011 | Gong et al. | |
| 2011/0251326 | A1 | 10/2011 | Van Hartingsveldt et al. | |
| 2011/0281135 | A1 | 11/2011 | Gong et al. | |
| 2012/0045658 | A1 | 2/2012 | Gong et al. | |
| 2012/0114968 | A1 | 5/2012 | Gong et al. | |
| 2012/0121928 | A1 | 5/2012 | Gong et al. | |

FOREIGN PATENT DOCUMENTS

| | | | |
|---|---|---|---|
| CN | 1518850 | A | 8/2004 |
| CN | 1523138 | A | 8/2004 |
| CN | 1542547 | A | 11/2004 |
| CN | 1666583 | A | 9/2005 |
| CN | 1238572 | C | 1/2006 |
| CN | 101113527 | A | 1/2008 |
| CN | 101268134 | A | 9/2008 |
| CN | 101299910 | A | 11/2008 |
| CN | 101394710 | A | 3/2009 |
| CN | 101634018 | A | 1/2010 |
| CN | 101654564 | A | 2/2010 |
| CN | 102071411 | A | 5/2011 |
| CN | 102277569 | A | 12/2011 |
| CN | 101747650 | B | 1/2012 |
| DE | 19852776 | A1 | 5/2000 |
| EP | 0230128 | A2 | 7/1987 |
| EP | 0298345 | A2 | 1/1989 |
| EP | 0311274 | A2 | 4/1989 |
| EP | 1 062 850 | | 12/2000 |
| EP | 1367872 | A2 | 12/2003 |
| EP | 1650249 | A1 | 4/2006 |
| JP | 51-80347 | | 7/1976 |
| JP | 58-018932 | | 2/1983 |
| JP | 61-185555 | | 8/1986 |
| JP | 2-285076 | | 11/1990 |
| JP | 2-305969 | | 12/1990 |
| JP | 3-52945 | | 3/1991 |
| JP | 2001-271171 | | 10/2001 |
| JP | 2006-124701 | | 5/2006 |
| JP | 2007-27312 | | 2/2007 |
| RU | 2188879 | C2 | 9/2002 |
| RU | 2192715 | C1 | 11/2002 |
| WO | WO 98/44165 | A1 | 10/1998 |
| WO | WO 00/15007 | A1 | 3/2000 |
| WO | WO 00/35259 | A2 | 6/2000 |
| WO | WO 03/005784 | A2 | 1/2003 |
| WO | WO 2008/064863 | A1 | 6/2008 |
| WO | WO 2009/009070 | A1 | 1/2009 |
| WO | WO 2009/141800 | A2 | 11/2009 |
| WO | WO 2010/022641 | A1 | 3/2010 |
| WO | WO 2011/072506 | A1 | 6/2011 |

OTHER PUBLICATIONS

Non-final Office Action dated Nov. 26, 2013, issued in related U.S. Appl. No. 13/354,512 (7 pages).

Non-final Office Action dated May 31, 2012, issued in related U.S. Appl. No. 13/350,161 (12 pages).

Final Office Action dated Jan. 16, 2013, issued in related U.S. Appl. No. 13/350,161 (8 pages).

Non-final Office Action dated Jul. 1, 2013, issued in related U.S. Appl. No. 13/350,161 (12 pages).

Non-final Office Action dated Mar. 11, 2014, issued in related U.S. Appl. No. 13/350,161 (15 pages).

Non-final Office Action dated Apr. 9, 2013, issued in related U.S. Appl. No. 13/128,401 (39 pages).

Final Office Action dated Aug. 14, 2013, issued in related U.S. Appl. No. 13/128,401 (39 pages).

Chinese First Office Action dated Jun. 16, 2011, issued in Chinese Application No. 200910261216.2 (10 pages).

Chinese First Office Action dated Jul. 28, 2011, issued in Chinese Application No. 200910238957.9 (16 pages).

Chinese First Office Action dated Jul. 28, 2011, issued in Chinese Application No. 201010044447.0 (8 pages).

Chinese First Office Action dated Aug. 4, 2011, issued in Chinese Application No. 201010117125.4 (9 pages).

Chinese First Office Action dated Aug. 5, 2011, issued in Chinese Application No. 201010260236.0 (9 pages).

Chinese First Office Action dated Aug. 1, 2012, issued in Chinese Application No. 201110202091.3 (8 pages).

Chinese First Office Action dated Aug. 1, 2012, issued in Chinese Application No. 201110202369.7 (8 pages).

Chinese First Office Action dated Sep. 5, 2012, issued in Chinese Application No. 201110202402.6 (8 pages).

European Examination Report dated Mar. 26, 2013, issued in European Application No. 10193044.4 (4 pages).

European Examination Report dated Oct. 1, 2013, issued in European Application No. 10827682.5 (5 pages).

European Examination Report dated Oct. 1, 2013, issued in European Application No. 13151234.5 (5 pages).

Extended European Search Report dated Mar. 31, 2011, issued in European Application No. 10193044.4 (11 pages).

Extended European Search Report dated Jun. 25, 2012, issued in European Application No. 10827682.5 (14 pages).

Extended European Search Report dated Apr. 5, 2013, issued in European Application No. 13151234.5 (5 pages).

Extended European Search Report dated Apr. 5, 2013, issued in European Application No. 13151235.2 (5 pages).

Extended European Search Report dated Apr. 5, 2013, issued in European Application No. 13151236.0 (5 pages).

Extended European Search Report dated Oct. 7, 2013, issued in European Application No. 13177928.2 (7 pages).

Partial European Search Report dated Feb. 7, 2011, issued in European Application No. 10193044.4 (6 pages).

Japanese Office Action dated Sep. 17, 2013, issued in Japanese Application No. 2012-505042 (6 pages).

Japanese Office Action dated Sep. 17, 2013, issued in Japanese Application No. 2012-506325 (6 pages).

(56) References Cited

OTHER PUBLICATIONS

Japanese Office Action dated Sep. 17, 2013, issued in Japanese Application No. 2012-506332 (7 pages).
Korean Office Action dated Mar. 15, 2013, issued in Korean Application No. 10-2011-7020318 (9 pages).
Korean Office Action dated Mar. 15, 2013, issued in Korean Application No. 10-2011-7020319 (7 pages).
Korean Office Action dated Mar. 15, 2013, issued in Korean Application No. 10-2011-7020337 (9 pages).
Korean Office Action dated Jul. 1, 2013, issued in Korean Application No. 10-2011-7020318 (4 pages).
Korean Office Action dated Jul. 1, 2013, issued in Korean Application No. 10-2011-7020319 (6 pages).
Korean Office Action dated Jul. 1, 2013, issued in Korean Application No. 10-2011-7020337 (5 pages).
Korean Office Action dated Jul. 1, 2013, issued in Korean Application No. 10-2013-7012557 (8 pages).
Korean Office Action dated Jul. 1, 2013, issued in Korean Application No. 10-2013-7013356 (8 pages).
Korean Office Action dated Jul. 1, 2013, issued in Korean Application No. 10-2013-7013357 (4 pages).
Korean Office Action dated Jul. 1, 2013, issued in Korean Application No. 10-2013-7013358 (4 pages).
Korean Office Action dated Oct. 18, 2013, issued in Korean Application No. 10-2011-7020319 (10 pages).
Korean Office Action dated Oct. 18, 2013, issued in Korean Application No. 10-2011-7020337 (8 pages).
Korean Office Action dated Oct. 18, 2013, issued in Korean Application No. 10-2013-7012557 (7 pages).
Korean Office Action dated Oct. 18, 2013, issued in Korean Application No. 10-2013-7013356 (6 pages).
Korean Office Action dated Oct. 18, 2013, issued in Korean Application No. 10-2013-7013357 (9 pages).
Korean Office Action dated Oct. 18, 2013, issued in Korean Application No. 10-2013-7013358 (10 pages).
PCT International Search and Written Opinion dated Sep. 23, 2010, issued in International Application No. PCT/CN2010/072055 (12 pages).
PCT International Search and Written Opinion dated Oct. 28, 2010, issued in International Application No. PCT/CN2010/075232 (12 pages).
PCT International Search and Written Opinion dated Feb. 24, 2011, issued in International Application No. PCT/CN2010/078700 (15 pages).
PCT International Search and Written Opinion dated Nov. 24, 2011, issued in International Application No. PCT/CN2011/078487 (12 pages).
Ahmed et al., "Laser induced structural and transport properties change in Cu—Zn ferrites", *J. Mater. Sci.*, vol. 42, 2007, pp. 4098-4109.
DeSilva et al., "A New Technique to Generate Conductive Paths in Dielectric Materials", *Mat. Res. Soc. Symp. Proc.*, vol. 323, 1994, pp. 97-102.
Esser et al., "Laser Assisted Techniques for Patterning of Conductive Tracks on Molded Interconnect Devices", Proceedings of the Technical Program, 1998, pp. 225-233.
Shafeev, "Laser-assisted activation of dielectrics for electroless metal plating", *Appl. Phys. A.*, vol. 67, 1998, pp. 303-311.
Examiner's Answer to Appeal Brief dated Jan. 29, 2014, issued in related U.S. Appl. No. 13/103,859, (13 pages).
Office Action dated Mar. 11, 2014, issued in related U.S. Appl. No. 13/350,161, (15 pages).
Eber-Gred, "Synthesis of Copper-Based Transparent Conductive Oxides with Delafossite Structure via Sol-Gel Processing", Dissertation, 2010 (208 pages).

* cited by examiner

METALIZED PLASTIC ARTICLES AND METHODS THEREOF

CROSS-REFERENCE TO RELATED APPLICATION

This application claims priority to, and benefit of Chinese Patent Application No. 201010117125.4 filed with State Intellectual Property Office, China, on Feb. 26, 2010, the entire content of which is incorporated herein by reference.

FIELD

The present disclosure relates generally to plastic articles. In particular, the present disclosure relates to a surface metallization method for plastic articles.

BACKGROUND

Metalization, also spelled metallization, is the process in which a non-metal substrate, such as a plastic, is coated, deposited, or otherwise provided, with a metallic layer or plating. Without wishing to be bound by the theory, Applicant believes that the metalization process may improve the substrates' ability to transmit, or otherwise transfer, electric and/or magnetic signals.

Plastic substrates having a metalized layer on their surfaces as pathways of electromagnetic signal conduction are widely used in automobiles, industries, computers and telecommunications etc. Selectively forming a metalized layer is one of the important processes for preparing such plastic products. The method for forming a metalized layer in prior art is usually practiced by forming a metal core as a catalytic center on the plastic support surface so that chemical plating may be performed. However, processes related thereto are complex where strict demand on equipment is needed whereas the energy consumption is high. Further, there is a low adhesive force between the coating and the plastic support.

SUMMARY

In viewing thereof, there remains an opportunity to provide a method for preparing a plastic article, in which the plastic metallization is easily performed with lower energy consumption and enhanced adhesive force between the metal layer and the plastic support.

In accordance with various illustrative embodiments hereinafter disclosed are methods of metalizing a plastic substrate. The method may include providing a plastic substrate having a plastic and a plurality of accelerators dispersed in the plastic. The accelerators may have a formula, $AM_xB_yO_z$, wherein: A is one or more elements selected from groups 10 and 11 of the Element Periodic Table; M is one or more metal elements in three plus selected from the group consisting of Fe, Co, Mn, Al, Ga, In, Tl, and rare earth elements; and O is oxygen; and x=0-2, y=0.01-2, and z=1-4. The accelerators may have an alternative formula, $A'M'_mO_n$, wherein A' is one or more elements selected from groups 9, 10, and 11 of the periodic table; M is one or more elements selected from the group consisting of Cr, Mo, W, Se, Te, and Po; and O is oxygen; and m=0.01-2, and n=2-4. The method may include the step of irradiating a surface of a plastic substrate, optionally by a laser irradiation, to expose at least a first accelerator. The method may further include plating the irradiated surface of the plastic substrate to form at least a first metal layer on the at least first accelerator, and then plating the first metal layer to form at least a second metal layer.

In accordance with another illustrative embodiment hereinafter disclosed are plastic articles comprising: a plastic substrate having a plastic and a plurality of accelerators, which substrate is plated with at least first and second metal layers. The accelerators may have a formula, $AM_xB_yO_z$, wherein: A is one or more elements selected from groups 10 and 11 of the Element Periodic Table; M is one or more metal elements in three plus selected from the group consisting of Fe, Co, Mn, Al, Ga, In, Tl, and rare earth elements; and O is oxygen; and x=0-2, y=0.01-2, and z=1-4. The accelerators may have an alternative formula, $A'M'_mO_n$, wherein A' is one or more elements selected from groups 9, 10, and 11 of the periodic table; M is one or more elements selected from the group consisting of Cr, Mo, W, Se, Te, and Po; and O is oxygen; and m=0.01-2, and n=2-4.

Additional aspects and advantages of the embodiments of present disclosure will be given in part in the following descriptions, become apparent in part from the following descriptions, or be learned from the practice of the embodiments of the present disclosure.

DETAILED DESCRIPTION OF THE EMBODIMENT

Reference will be made in detail to embodiments of the present disclosure. The embodiments described herein are explanatory, illustrative, and used to generally understand the present disclosure. The embodiments shall not be construed to limit the present disclosure. The same or similar elements and the elements having same or similar functions are denoted by like reference numerals throughout the descriptions.

In an illustrative, non-limiting, embodiment of the present disclosure, a method of metalizing a plastic substrate is provided. The method may include providing a plastic substrate having a plastic and a plurality of accelerators dispersed in the plastic. The accelerators may have a formula, $AM_xB_yO_z$, wherein: A is one or more elements selected from groups 10 and 11 of the Element Periodic Table; M is one or more metal elements in three plus selected from the group consisting of Fe, Co, Mn, Al, Ga, In, Tl, and rare earth elements; and O is oxygen; and x=0-2, y=0.01-2, and z=1-4. The accelerators may have an alternative formula, $A'M'_mO_n$, wherein A' is one or more elements selected from groups 9, 10, and 11 of the periodic table; M is one or more elements selected from the group consisting of Cr, Mo, W, Se, Te, and Po; and O is oxygen; and m=0.01-2, and n=2-4. The method may include the step of irradiating a surface of a plastic substrate, optionally by a laser irradiation, to expose at least a first accelerator. The method may further include plating the irradiated surface of the plastic substrate to form at least a first metal layer on the at least first accelerator, and then plating the first metal layer to form at least a second metal layer.

Accelerators

In an illustrative, non-limiting, embodiment, the accelerators may have a formula $AM_xB_yO_z$, wherein: A is one or more elements selected from groups 10 and 11 of the Element Periodic Table; M is one or more metal elements in three plus selected from the group consisting of Fe, Co, Mn, Al, Ga, In, Tl, and rare earth elements; and O is oxygen; and x=0-2, y=0.01-2, and z=1-4. The accelerators may have an alternative formula, $A'M'_mO_n$, wherein A' is one or more elements selected from groups 9, 10, and 11 of the periodic table; M is one or more elements selected from the group consisting of Cr, Mo, W, Se, Te, and Po; and O is oxygen; and m=0.01-2, and n=2-4. For example, the accelerator may have a formula of $AM_xB_yO_z$, in which A may be Cu and Ni. Particularly suitable accelerators may include: $CuFe_{0.5}B_{0.5}O_{2.5}$, $CuNi_{0.5}B_{0.5}O_{2.5}$, $CuAl_{0.5}B_{0.5}O_{2.5}$, $CuGa_{0.5}B_{0.5}O_{2.5}$, $CuB_2O_4$ or $CuB_{0.7}O_2$. The accelerator may have an alternative formula of $A'M'_mO_n$, in which A' may be Co, Ni or Cu. Still further suitable accelerators, without limitation, may include $CuMo_{0.7}O_3$, $CuMo_{0.5}O_{2.5}$, $CuMoO_4$, $CuWO_4$ or $CuSeO_4$.

Without wishing to be bound by the theory, Applicant believes that accelerators with a general formula of $AM_xB_yO_z$ or $A'M'_mO_n$ may favor a direct copper-plating or nickel-plating, and serve to avoid, or otherwise mitigate, plastic degradation.

In a non-limiting embodiment, the average diameter of each accelerator may range from about 20 nanometers to about 100 microns, alternatively from about 50 nanometers to about 10 microns, and alternatively from about 200 nanometers to about 4 microns. The accelerators may be from about 1 wt % to about 40 wt % of the plastic substrate, alternatively from about 1 wt % to about 30 wt %, and alternatively from about 2 wt % to about 15 wt %.

In a further illustrative, non-limiting, embodiment, the accelerators may be uniformly dispersed within the plastic. Without wishing to be bound by the theory, Applicant believes that a uniform dispersion of accelerators in the plastic aides in forming a strong adhesion between the metal layer and the plastic substrate.

Methods of preparing suitable accelerators are generally known. In an example, the accelerator may be $CuWO_4$ commercially available from Mitsuwa Chemical Co. Ltd. In one non-limiting example, a method for preparing $CuGa_{0.5}B_{0.5}O_{2.5}$ comprises the steps of: mixing and ball milling 58 g of CuO, 34 g of $Ga_2O_3$ and 14 g of $B_2O_3$ powders; and calcining the powders under a temperature of about 1000 degrees centigrade (° C.) for about 2 hours to form the accelerator with an average particle diameter of about 1.0 micron to about 2.5 microns, wherein the accelerator thus obtained has a composition of $CuGa_{0.5}B_{0.5}O_{2.5}$ tested by ICP-AES. Similarly, a method for preparing $CuMoO_4$ may comprise the steps of: mixing and ball milling CuO and $MoO_3$ powders; and calcining under a temperature of about 800° C. for about 2 hours to form the accelerator, wherein the accelerator thus obtained has a composition of $CuMoO_4$ tested by XRD.

Significant research shows that, except that pure Cu and Pd may be used as the nucleus or grain for chemical plating, nano-CuO can improve the chemical deposition speed of the metal atoms on a plastic surface during chemical plating. The inventors have discovered that nano-CuO particles (commercially available from Aladin Reagent Co., Ltd) with an average particle size of about 40 nm in a normal chemical plating solution may cause a fast deposition of Cu on the surface of nano-CuO particles. However, nano-CuO may also cause the degradation of the plastic. By many experiments, the inventors have discovered that the accelerators represented by the general formula of $AM_xB_yO_z$ or $A'M'_mO_n$ may be used for surface treatment, and such accelerators may promote the chemical deposition of chemical plating on plastic surfaces and can remain in the plastic for a long period of time without causing the degradation of the plastic.

According to an embodiment of the disclosure, the accelerator may be evenly distributed in the plastic. The adhesive force between the accelerator and the plastic substrate is very high so that the following chemical plating may be performed on the surface of the accelerator directly. As a result, the adhesive force between the formed coating layer and the plastic substrate may be increased tremendously.

Plastic

In an illustrative, non-limiting, embodiment, the plastic may be a thermoplastic plastic, or thermoset otherwise called a thermosetting plastic. The thermoplastic plastic may be selected from the group consisting of polyolefins, polycarbonates (PC), polyesters, polyamides, polyaromatic ethers, polyester-imides, polycarbonate/acrylonitrile-butadiene-styrene composite (PC/ABS), polyphenylene oxide (PPO), polyphenylene sulfide (PPS), polyimides (PI), polysulfones (PSU), poly (ether ether ketone) (PEEK), polybenzimidazole (PBI), liquid crystalline polymer (LCP) and any combination thereof. The polyolefins may be selected from polystyrene (PS), polypropylene (PP), polymethyl methacrylate (PMMA) or poly(acrylonitrile-butadiene-styrene) (ABS). The polyesters may be selected from polycyclohexylene dimethylene terephthalate (PCT), poly(diallyl isophthalate) (PDAIP), poly(diallyl phthalate) (PDAP), polybutylene naphthalate (PBN), Poly(ethylene terephthalate) (PET), or polybutylene terephthalate (PBT). The polyamides may be selected from polyhexamethylene adipamide (PA-66), poly (hexamethylene azelamide) (PA-69), polyhexamethylene succinamide (PA-64), poly(hexamethylene dodecanoamide) (PA-612), poly(hexamethylene sebacamide) (PA-610), poly (decametylene sebacamide) (PA-1010), polyundecanoamide (PA-11), polydodecanoamide (PA-12), polycapryllactam (PA-8), polyazelamide (PA-9), polycaprolactam (PA-6), poly (p-phenytene terephthalamide) (PPTA), poly-m-xylylene adipamide (MXD6), polyhexamethylene terephthalamide (PA6T), or poly(nonamethylene terephthalamide) (PAST). The liquid crystalline polymer (LCP) may be a polymer comprising rigid chains and being capable of forming regions of highly ordered structure in the liquid phase. The thermosetting resin includes a material selected from the group consisting of phenolic resin, urea-formaldehyde resin, melamine-formaldehyde resin, epoxy resin, alkyd resin, polyurethane and any combination thereof.

Dispersion of Accelerator(s) in Plastic

In an illustrative, non-limiting, embodiment, the accelerator(s) may be dispersed within the plastic by any method of mixture or combination, followed, without limitation, by an optional molding process. In various embodiments, the accelerator(s) may become dispersed in the plastic by using an internal mixer, a singer screw extruder, a twin screw extruder or a mixer. In various embodiments, the term "plastic substrate" means a plastic having accelerator(s) disposed, or dispersed, therein. Following the dispersion of the accelerator(s) in the plastic, the plastic substrate may be formed into various kinds of shapes during an injection molding, blow molding, extraction molding, or hot press molding processes.

Additives

In illustrative, non-limiting, embodiments, the plastic substrate may further comprise one or more generally known, and commercially available, additives selected from the group consisting of: an antioxidant; a light stabilizer; a lubricant; and inorganic fillers. In a non-limiting embodiment, the antioxidant may be antioxidant 1098, 1076, 1010, 168 available from Chemical Industries Basel Co., located in or near Basel, Switzerland. The antioxidant may be about 0.01 wt % to about 2 wt % of the plastic substrate.

The light stabilizer may be any such commercially available product, including a hindered amine light stabilizer, such as light stabilizer 944 available from Chemical Industries Basel Co., located in or near Basel, Switzerland. The light stabilizer may be about 0.01 wt % to about 2 wt % of the plastic substrate.

In a non-limiting embodiment, the lubricant may be selected from the group consisting of: methylpolysiloxanes;

EVA waxes formed from ethylene and vinyl acetate; polyethylene waxes; stearates; and combinations thereof. The lubricant may be about 0.01 wt % to about 2 wt % of the plastic substrate.

In a non-limiting embodiment, the inorganic filler may be talcum powders, calcium carbonates, glass fibers, calcium carbonate fibers, tin oxides, or carbon blacks. In further embodiments, the inorganic filler may further selected from the group consisting of glass beads, calcium sulfates, barium sulfates, titanium dioxides, pearl powders, wollastonites, diatomites, kaolins, pulverized coals, pottery clays, micas, oil shale ashes, aluminosilicates, aluminas, carbon fibers, silicon dioxides, zinc oxides, and combinations thereof, particularly those without harmful elements (Cr, etc) to the environment and human health. The inorganic filler may be about 1 wt % to about 70 wt % of the plastic substrate.

Irradiation

In an illustrative, non-limiting, embodiment, a surface of the plastic substrate is irradiated to expose at least a first accelerator. In an embodiment, irradiation may be achieved by exposing a portion of the surface of the plastic substrate by laser radiation. In an embodiment, a sufficient portion of the surface of the plastic substrate may be irradiated, optionally by laser, to expose at least one accelerator, and alternatively a plurality of accelerators. The laser instrument may be an infrared laser, such as a $CO_2$ laser marking system. In a non-limiting embodiment, the laser may have a wavelength ranging from about 157 nanometers to about 10.6 microns; a scanning speed of about 500 millimeters per second to about 8000 millimeters per second; a scanning step of about 3 microns to about 9 microns; a scan time delay of about 30 microseconds to about 100 microseconds; a frequency of about 30 kilohertz to about 40 kilohertz; a power of about 3 watt to about 4 watt; and a filling space of about 10 microns to about 50 microns. According to various embodiments of the present disclosure, the power of the laser may be sufficiently great to expose at least one accelerator, and alternatively a plurality of accelerators, but not so strong as to alter or damage the accelerators, or reduce the accelerators to metals.

In a non-limiting embodiment, the plastic substrate may have a thickness of about 500 microns, or more, and the depth of the irradiated portion of the plastic substrate may be about 20 microns, or less. In an embodiment, the areas without accelerators are not irradiated, and, without wishing to be bound by the theory, Applicant believes that those areas may have low deposition speed and poor adhesion. While, a few metals may deposit in these areas they may be easily removed by, for example and without limitation, ultrasonic cleaning. In this manner, Applicant believes, without wishing to be bound by such, that the metalization may be controlled in required areas in the surface of the plastic substrate.

In a further illustrative, non-limiting, embodiments, a flowing device may be applied to remove any mist generated, or introduced, during the irradiation process in the un-irradiated areas. Additionally, in various non-limiting embodiments, the plastic substrate may be ultrasonically cleaned after laser irradiation.

According to an embodiment of the disclosure, there are substantially no chemical plating deposits on the surface of the plastic substrate where no accelerator exist. Thus, the electroplating speed is very low with weak adhesive force. Even there are a few chemical deposits, they may be removed easily. Thus, direct selective surface metalizing method may be achieved easily according to the present disclosure.

First Plating

In an embodiment, after irradiation the accelerators may be exposed in the surface of the plastic substrate. A copper and/or nickel plating may be introduced onto at least some of the accelerators. Without wishing to be bound by the theory, Applicant believes that introducing the copper and/or nickel plating onto at least some of the accelerators may result in a strong relatively adhesion between the plastic substrate and the plating layers.

In a non-limiting embodiment, after laser irradiation the accelerator(s) may be exposed in the irradiated areas. Thereafter, copper-plating or nickel-plating may be applied to the accelerator(s). The copper-plating and nickel-plating are generally known to those of ordinary skill in the art, and may include contacting the irradiated plastic substrate with a copper-plating or a nickel-plating bath (described below). Without wishing to be bound by the theory, Applicant believes that the exposed accelerators may favor the copper or nickel ions, to be reduced to copper or nickel powders, which may cover the surface of the accelerators, and form a dense copper layer or nickel layer rapidly on the accelerators.

Further Plating

In a non-limiting embodiment, following the first plating, one or more chemical, or electroplating, layers may be applied to the copper layer or nickel layer, or plate. For example, after a first nickel layer, or plating, may be formed on the surface(s) of the accelerator(s), a copper layer, or plating, may be chemical plated on the first nickel layer, or plate, and then a second nickel layer, or plate, may be chemically plated on the copper layer, or plate, to form a composite plastic article, having a layer, or plate, structure of Ni—Cu—Ni. Alternatively, an aurum layer may be flash layered, or plated, on the composite plastic article to form a plastic article having a layer, or plate, structure of Ni—Cu—Ni—Au.

In a further illustrative, non-limiting, embodiment, after a first copper layer, or plating, is formed on the surface(s) of the accelerator(s), a nickel layer, or plate, may be plated on the first copper layer, or plate, to form a layer, or plate, structure of Cu—Ni. Alternatively, an aurum layer may be flash layered, or plated, on the Cu—Ni layer, or plate, to form a layer, or plate, structure of Cu—Ni—Au.

In various non-limiting embodiments, the nickel layer, or plate, may have a thickness ranging from about 0.1 microns to about 50 microns, alternatively from about 1 micron to about 10 microns, and alternatively from about 2 microns to about 3 microns. The copper layer, or plate, may have a thickness ranging from about 0.1 microns to about 100 microns, alternatively from about 1 microns to about 50 microns, and alternatively from about 5 microns to about 30 microns. The aurum layer may have a thickness ranging from about 0.01 microns to about 10 microns, alternatively from about 0.01 microns to about 2 microns, and alternatively from about 0.1 microns to about 1 microns.

Chemical plating baths, electric solutions, and flash plating baths are generally known to those with ordinary skill in the art. In a non-limiting embodiment, the chemical plating bath for copper plating may comprise a copper salt and a reducer, with a pH value ranging from about 12 to about 13, wherein the reducer may reduce the copper ion to copper. The reducer may be selected from the group consisting of glyoxylic acids, hydrazines, sodium hypophosphites, and combinations thereof. In another embodiment, the chemical plating bath for copper plating may comprise 0.12 moles per liter ("mol/L") $CuSO_4.5H_2O$, 0.14 mol/L $Na_2EDTA.2H_2O$, 10 mol/L potassium ferrocyanide, 10 mg/L (milligram per liter) potassium ferrocyanide, 10 mg/L 2,2' bipyridine, and about 0.10 mol/L of glyoxylic acid (HCOCOOH), the bath having a pH of about 12.5 to about 13 adjusted by NaOH and $H_2SO_4$ solutions. In a non-limiting embodiment, the copper plating time may range from about 10 minutes to about 240 minutes. The chemical plating bath for nickel plating may comprise 23 grams per liter ("g/L") nickel sulfate, 18 g/L inferior sodium phosphate, 20 g/L lactic acid, 15 g/L malic acid, the bath having a pH of about 5.2 adjusted by a NaOH solution, and a temperature of about 85° C. to about 90° C. In a non-limiting embodiment, the nickel plating time may range from about 8 minutes to about 15 minutes.

Aurum flash plating is generally known to those with ordinary skill in the art. In a non-limiting embodiment, the flash plating bath may be a BG-24 neutral aurum bath, which is commercially available from Shenzhen Jingyanchuang Chemical Company, located in Shenzhen, China.

Additional details of the present disclosure will be provided as follows by some embodiments of the present disclosure.

Embodiment 1

A method for preparing a plastic article comprises the steps of:

a) $CuFe_{0.5}B_{0.5}O_{2.5}$ was ball milled in a high speed ball grinder for about 10 hours to form powders with an average diameter of about 700 nm; then PP, $CuFe_{0.5}B_{0.5}O_{2.5}$ powders, calcium silicate fiber, and antioxidant 1010 according to a weight ratio of about 100:10:30:0.2 were mixed in a high speed mixer to prepare a mixture; the mixture was extruded and granulated by a twin screw extruder available from Nanjing Rubber & Plastics Machinery Plant Co., Ltd., P. R. C. then injection molded to form a substrate of a circuit board for a LED (light emitting diode) lamp;

b) a metal circuit pattern was curved on the substrate by a DPF-M12 infrared laser available from Shenzhen TEC-H LASER Technology Co., Ltd., P. R. C. with a wavelength of about 1064 nm, a scanning speed of about 1000 mm/s, a scanning step size of about 9 μm, a scan time delay of about 30 μs, a frequency of about 40 KHz, a power of about 3 W, and a filled distance of about 50 μm; the surface of the plastic article was then ultrasonically cleaned; and c) the substrate was immersed in a chemical nickel plating solution for about 10 min to form a first nickel layer with a thickness of about 3 μm; the substrate was immersed in a chemical copper plating solution for about 4 hours to form a copper layer with a thickness of about 13 μm on the first nickel layer; thereafter the substrate was immersed in the chemical nickel plating solution for about 10 min again to form a second nickel layer with a thickness of about 3 μm on the copper layer; then the plastic substrate was flash plated with an aurum layer with a thickness of about 0.03 μm on the second nickel layer to form the plastic article as the substrate for a circuit board of a LED lamp; where the copper plating solution was comprised of about 0.12 mol/L of $CuSO_4.5H_2O$, about 0.14 mol/L of $Na_2EDTA.2H_2O$, about 10 mg/L of potassium ferrocyanide, about 10 mg/L of 2,2'-bipyridine, and about 0.10 mol/L of glyoxylic acid (HCOCOOH), with a PH value of about 12.5 to about 13 adjusted by NaOH and $H_2SO_4$; the nickel plating solution was comprised of about 23 g/L of nickel sulfate, about 18 g/L of sodium hypophosphite, about 20 g/L of lactic acid, about 15 g/L of malic acid, with a PH value of about 5.2 adjusted by NaOH; and the aurum strike plating solution was BG-24 neutral aurum plating solution commercially available from Shenzhen Jingyanchuang Chemical Company, P. R. C.

Embodiment 2

The method in Embodiment 2 is substantially similar in all respects to that in Embodiment 1, with the exception of:

in step a), $CuB_2O_4$ was ball milled to form powders with an average diameter of about 800 nm; the powders were dried and mixed with PEEK resin, glass fiber, and antioxidant 168 according to a weight ratio of about 20:100:30:0.2 in a high speed ball grinder to prepare a mixture; the mixture was extruded and granulated then injection molded to form a shell; and in step c), the shell was immersed in a chemical nickel plating solution for about 8 min to form a nickel layer with a thickness of about 2 μm; the shell was immersed in a chemical copper plating bath for about 3 hours to form a copper layer with a thickness of about 13 μm on the first nickel layer; then the shell was immersed in the chemical nickel plating solution for about 10 min again to form a second nickel layer with a thickness of about 3 μm on the copper layer; and then the plastic substrate was flash plated with an aurum layer with a thickness of about 0.03 μm on the second nickel layer to form the plastic article as a shell for an electronic connector shell of an automobile motor.

Embodiment 3

The method in Embodiment 3 is substantially similar in all respects to that in Embodiment 1, with the exception of:

in step a), $CuWO_4$ was ball milled to form powders with an average diameter of about 800 nm; the powders were dried and mixed with PES resin, $CuWO_4$, potassium titanate whisker, antioxidant 1010, and polyethylene wax according to a weight ratio of about 10:100:30:0.2:0.1 in a high speed ball grinder to prepare a mixture; the mixture was extruded and granulated then injection molded to form a shell; and in step c), the shell was immersed in a chemical copper plating solution for about 3 hours to form a copper layer with a thickness of about 5 μm; then the shell was immersed in a chemical nickel plating solution for about 10 min to form a nickel layer with a thickness of about 3 μm on the copper layer, thus forming the plastic article as a shell for an electronic connector.

Embodiment 4

The method in Embodiment 4 is substantially similar in all respects to that in Embodiment 1, with the exception of:

in step a), $CuMo_{0.5}O_{2.5}$ was ball milled to form powders with an average diameter of about 900 nm; the powders were dried and mixed with PC resin, $CuMo_{0.5}O_{2.5}$, antioxidant 1076, and polyethylene wax according to a weight ratio of about 10:100:0.2:0.1 in a high speed ball grinder to prepare a mixture; the mixture was extruded and granulated then blow molded to form a shell; and in step c), the shell was immersed in a chemical nickel plating solution for about 10 min again to form a first nickel layer with a thickness of about 3 μm; the shell was immersed in a chemical copper plating solution for about 2 hours to form a copper layer with a thickness of about 10 μm on the first nickel layer; then the shell was immersed in a chemical nickel plating solution for about 12 min again to form a second nickel layer with a thickness of about 4 μm on the copper layer; thus forming the plastic article as a shell for an electronic part of an automobile.

Embodiment 5

The method in Embodiment 5 is substantially similar in all respects to that in Embodiment 1, with the exception of:

in step a), $CuNi_{0.5}B_{0.5}O_{2.5}$ was ball milled to form powders with an average diameter of about 900 nm; the powders were dried and mixed with PPO resin, $CuNi_{0.5}B_{0.5}O_{2.5}$, calcium silicate fiber, antioxidant 1076, and polyethylene wax according to a weight ratio of about 10:100:10:0.2:0.1 in a high speed ball grinder to prepare a mixture; the mixture was extruded and granulated by a twin screw extruder then injection molded to form a shell; and in step c), the shell was immersed in a chemical nickel plating solution for about 8 min to form a nickel layer with a thickness of about 2 μm; the shell was immersed in a chemical copper plating bath for about 4 hours to form a copper layer with a thickness of about 15 μm on the first nickel layer; then the shell was immersed in the chemical nickel plating solution for about 10 min again to form a second nickel layer with a thickness of about 3 μm on the copper layer; and the shell was flash plated with an aurum layer with a thickness of about 0.03 μm on the second nickel layer; thus forming the plastic article as a shell for an outdoor connector of a solar cell.

Embodiment 6

A method for preparing a plastic article comprises the steps of:

a) 58 g of CuO, about 34 g of $Ga_2O_3$, and about 14 g of $B_2O_3$ powders were mixing uniformly; the powders ball milled in distilled water in a high speed ball grinder for about 12 hours to form a mixture; then the mixture was dried and calcined at a temperature of about 1000° C. for about 2 hours to form particles; the particles were ball milled at a high speed until the average diameter of the particles reached up to about 900 nm; the particles were tested by X-ray Diffraction (XRD) and ICP-AES to obtain a composition of $CuGa_{0.5}B_{0.5}O_{2.5}$;

b) PPS resin, $CuGa_{0.5}B_{0.5}O_{2.5}$ particles, antioxidant 1076, and polyethylene wax were mixed according to a weight ratio of about 100:10:0.2:0.1 to form a mixture; the mixture was extruded and granulated then injection molded to form a shell;

c) a metal circuit pattern was curved on the shell by a method substantially similar to that in step b) of Embodiment 1; and d) the plating step is substantially similar in all respects to step c) of Embodiment 1, with the exception of: the shell was immersed in a chemical copper plating solution for about 3 h to form a copper layer with a thickness of about 12 μm; thereafter, the shell was immersed in a chemical nickel plating bath for about 10 min to form a nickel layer with a thickness of about 3 μm on the first copper layer; thus forming the plastic article as a shell for an electric connector.

Embodiment 7

A method for preparing a plastic article comprises the steps of:

a) 36 g of CuO, and about 65 g of $MoO_3$ powders were mixed uniformly; the powders were ball milled in distilled water in a high speed ball grinder for about 12 hours to form a mixture; the mixture was dried then calcined at a temperature of about 800° C. for about 2 hours to from particles; the particles were ball milled until the average diameter reaches about 900 nm; the particles were tested by XRD and obtained a composition of $CuMoO_4$;

PA6T resin, $CuMoO_4$, antioxidant 1076, and polyethylene wax were mixed according to a weight ratio of about 100:10:0.2:0.1 to form a mixture; the mixture was extruded and granulated then injection molded to form a shell;

c) a metal circuit pattern was curved on the shell by a method substantially similar to that in step b) of Embodiment 1; and d) the plating step was substantially similar in all respects to step c) of Embodiment 3 with the exception of: the shell was immersed in a chemical nickel plating solution for about 8 min to form a copper layer with a thickness of about 2 μm; the shell was immersed in a chemical copper plating solution for about 14 h min to form a copper layer with a thickness of about 15 μm on the nickel layer; then the shell was immersed in a chemical nickel plating solution for about 10 min to form a nickel layer with a thickness of about 3 μm on the copper layer; and the shell was flash plated with an aurum layer with a thickness of about 0.03 μm on the nickel layer; thus forming the plastic article as a shell for an outdoor connector of a automobile.

Although explanatory embodiments have been shown and described, it would be appreciated by those skilled in the art that changes, alternatives, and modifications all falling into the scope of the claims and their equivalents can be made in the embodiments without departing from spirit and principles of the disclosure.

What is claimed is:

1. A method of metalizing a plastic substrate comprising:

providing a plastic substrate comprising a plastic and a plurality of accelerators dispersed in the plastic, the plurality of accelerators being of a formula $AM_xB_yO_z$, wherein A is one or more elements selected from groups 10 and 11 of the Element Periodic Table; M is one or more metal elements in three plus selected from the group consisting of Fe, Co, Mn, Al, Ga, In, Tl, and rare earth elements; B is boron and O is oxygen; and x=0-2, y=0.01-2, and z=1-4;

irradiating a surface of the plastic substrate with an infrared laser to expose at least a first accelerator;

plating the irradiated surface of the plastic substrate to form at least a first metal layer on the at least first accelerator, wherein the first metal layer is electrochemically or chemically plated.

2. The method of claim 1, wherein the plastic substrate is provided by a molding process selected from the group consisting of injection molding, blow molding, extraction molding, and hot press molding.

3. The method of claim 1, wherein the plastic is selected from the group consisting of a thermoplastic and a thermoset; the plurality of accelerators are evenly distributed throughout the plastic; the irradiated surface of the plastic substrate is copper-plated or nickel plated; and the surface of the plastic substrate is irradiated by exposure to a laser radiation, wherein the method further comprising plating the first metal layer to form at least a second metal layer.

4. The method of claim 3, wherein the laser radiation has a wave length of about 10.6 microns.

5. The method of claim 3, wherein the metal layers have a structure selected from the group consisting of a layer of Ni, a layer of Cu on the layer of Ni, and a layer of Ni on the layer of Cu; a layer of Ni, a layer of Cu on the layer of Ni, and a second layer of Ni on the layer of Cu, and a layer of Au on the second layer of Ni; a layer of Ni, a layer of Cu on the layer of Ni; and a layer of Cu, a layer of Ni on the layer of Cu, and a layer of Au on the layer of Ni.

6. The method of claim 5, wherein the nickel layers each have a thickness ranging from about 0.1 microns to about 50 microns; the copper layers each have a thickness ranging from about 0.1 microns to about 100 microns; and the gold layers each have a thickness ranging from about 0.01 microns to about 10 microns.

7. The method of claim 3, wherein: the thermoplastic plastic is selected from the group consisting of polyolefins, polycarbonates, polyesters, polyamides, polyaromatic ethers, polyester-imides, polycarbonate/acrylonitrile-butadiene-styrene composite, polyphenylene oxide, polyphenylene sulfide, polyimides, polysulfones, poly (ether ether ketone), polybenzimidazole, liquid crystalline polymer and any combination thereof; and the thermoset is selected from the group consisting of phenolic resin, urea-formaldehyde resin, melamine-formaldehyde resin, epoxy resin, alkyd resin, polyurethane and combinations thereof.

8. The method of claim 1, wherein the plurality of accelerators each have an average diameter ranging from about 20 nanometers to about 100 microns.

9. The method of claim 1, wherein the plurality of accelerators of a formula of $AM_xB_yO_z$ are selected from the group consisting of: $CuFe_{0.5}B_{0.5}O_{2.5}$, $CuAl_{0.5}B_{0.5}O_{2.5}$, $CuGa_{0.5}B_{0.5}O_{2.5}$, $CuB_2O_4$, and $CuB_{0.7}O_2$.

10. The method of claim 1, wherein the plurality of accelerators are about 1 wt % to about 40 wt % of the plastic substrate.

11. The method of claim 1, wherein the plastic substrate further comprises at least one additive selected from the group consisting of: an antioxidant, a light stabilizer, a lubricant, and inorganic fillers.

12. The method of claim 1, wherein irradiating a surface of the plastic substrate comprises irradiating the surface of the plastic substrate with a laser radiation having a power of about 3 watts to about 4 watts.

13. The method of claim 1, wherein irradiating a surface of the plastic substrate comprises irradiating the surface of the plastic substrate with a laser radiation having a frequency of about 30 kilohertz to about 40 kilohertz.

* * * * *

UNITED STATES PATENT AND TRADEMARK OFFICE

CERTIFICATE OF CORRECTION

PATENT NO. : 9,103,020 B2
APPLICATION NO. : 12/950904
DATED : August 11, 2015
INVENTOR(S) : Gong et al.

It is certified that error appears in the above-identified patent and that said Letters Patent is hereby corrected as shown below:

In the claims

Claim 1, col. 10, lines 38-39, after “plastic substrate” delete “with an infrared laser”.

Signed and Sealed this
Sixteenth Day of February, 2016

Michelle K. Lee

Michelle K. Lee
*Director of the United States Patent and Trademark Office*